US010962334B2

(12) United States Patent
Ahrens

(10) Patent No.: US 10,962,334 B2
(45) Date of Patent: Mar. 30, 2021

(54) BALLISTIC ARMOR

(71) Applicant: Armor at Hand, Hermosa Beach, CA (US)

(72) Inventor: Chad A. Ahrens, Hermosa Beach, CA (US)

(73) Assignee: Armor at Hand, Hermosa Beach, CA (US)

( * ) Notice: Subject to any disclaimer, the term of this patent is extended or adjusted under 35 U.S.C. 154(b) by 0 days.

(21) Appl. No.: 16/284,338

(22) Filed: Feb. 25, 2019

(65) Prior Publication Data

US 2019/0293390 A1 Sep. 26, 2019

Related U.S. Application Data

(60) Provisional application No. 62/772,332, filed on Nov. 28, 2018, provisional application No. 62/680,289, filed on Jun. 4, 2018, provisional application No. 62/638,714, filed on Mar. 5, 2018.

(51) Int. Cl.

| | |
|---|---|
| ***F41H 5/08*** | (2006.01) |
| ***G08C 17/00*** | (2006.01) |
| ***G08C 21/00*** | (2006.01) |
| ***F41H 5/04*** | (2006.01) |

(52) U.S. Cl.

CPC ..... *F41H 5/08* (2013.01); *F41H 5/0457* (2013.01); *G08C 17/00* (2013.01); *G08C 21/00* (2013.01)

(58) Field of Classification Search

CPC ..... F41H 5/08; F41H 1/00

See application file for complete search history.

(56) References Cited

U.S. PATENT DOCUMENTS

| | | | | |
|---|---|---|---|---|
| 9,010,231 | B1 * | 4/2015 | Cohn | F41H 5/08 89/36.07 |
| 2008/0064339 | A1 * | 3/2008 | Cavalier | H04M 1/72538 455/66.1 |
| 2015/0338193 | A1 * | 11/2015 | Walker | F41H 1/02 89/36.02 |
| 2018/0372455 | A1 * | 12/2018 | Klassen | G09F 23/00 |

* cited by examiner

*Primary Examiner* — J. Woodrow Eldred

(74) *Attorney, Agent, or Firm* — Schmelzer IP

(57) ABSTRACT

Inconspicuous ballistic armor that may be incorporated into or disguised within everyday articles in the environment in which it is deployed. The ballistic armor includes a ballistic shield, an article attached to the front surface of the ballistic shield, and hand/arm straps attached to a rear surface of the ballistic shield. A thin sheet of hardened abrasion-resistant steel may alternatively be affixed to the ballistic shield core and may wrap around the core slightly to allow for attachment of arm straps and hand holds behind the shield. Examples of the article attached to the front surface include a desktop calendar, a whiteboard, corkboard and artwork. The ballistic shield is formed from high strength, lightweight synthetic fiber that can withstand gunfire. The hand/arm straps may be formed from a webbing strap material that is attached, such as by rivets or special fasteners, to the rear surface of the ballistic shield. An autonomous alert and movement tracking system connects the shields to the Internet to allow generation of a map showing locations and movements of shields, and predictive location and movement of the attacker, for use by both the users of the shields and first responders. The shields may also have audio and visual indicators to allow display of alerts.

12 Claims, 12 Drawing Sheets

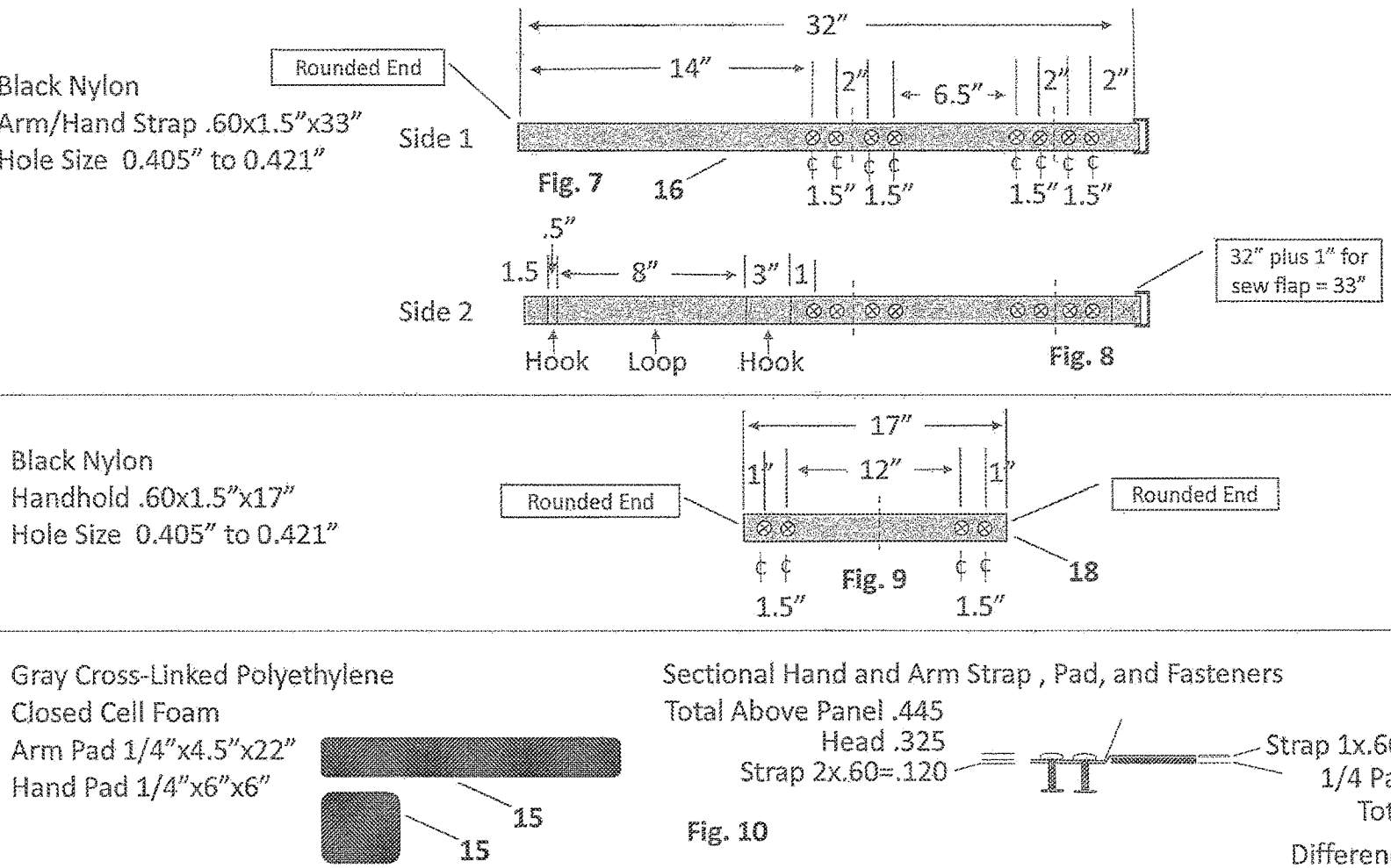
Rounded End
Black Nylon
Arm/Hand Strap .60x1.5"x33"
Hole Size 0.405" to 0.421"
Side 1
32"
14"
2"
2"
6.5"
1.5"
1.5"
1.5"
1.5"
16
Fig. 7
32" plus 1" for sew flap = 33"
Side 2
.5"
1.5
8"
3"
1
Hook
Loop
Hook
Fig. 8
Rounded End
Black Nylon
Handhold .60x1.5"x17"
Hole Size 0.405" to 0.421"
Rounded End
17"
12"
1"
1"
1.5"
1.5"
18
Fig. 9
Sectional Hand and Arm Strap , Pad, and Fasteners
Total Above Panel .445
Head .325
Strap 2x.60=.120
Strap 1x.60=.060
1/4 Pad .25
Total .310
Difference .135
Fig. 10
Gray Cross-Linked Polyethylene
Closed Cell Foam
Arm Pad 1/4"x4.5"x22"
Hand Pad 1/4"x6"x6"
15
15

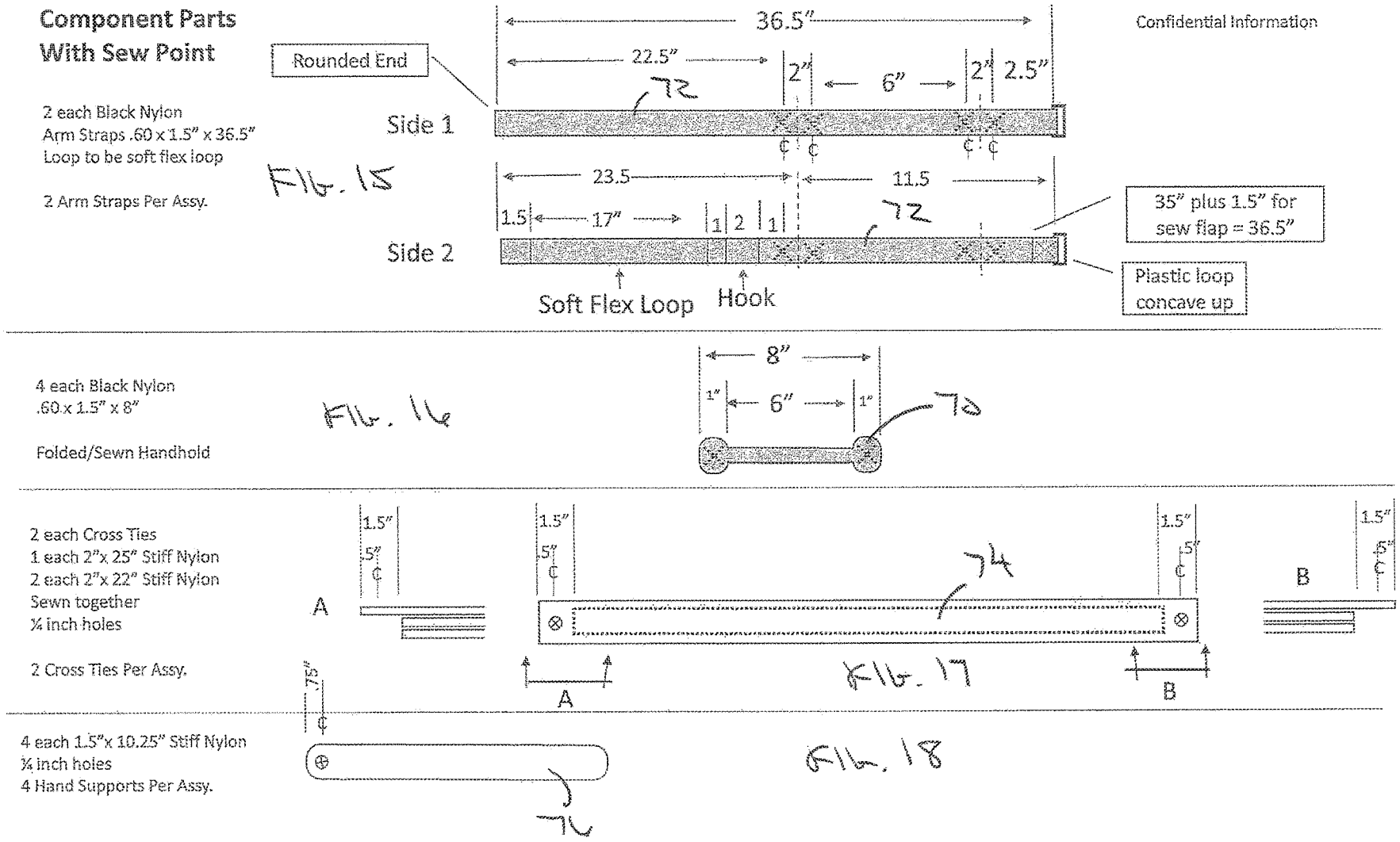
Confidential Information
Component Parts
With Sew Point
2 each Black Nylon
Arm Straps .60 x 1.5" x 36.5"
Loop to be soft flex loop
2 Arm Straps Per Assy.
Rounded End
Side 1
Side 2
36.5"
22.5"
2"
6"
2"
2.5"
23.5
17"
1.5
11.5
1
2
1
Soft Flex Loop
Hook
35" plus 1.5" for sew flap = 36.5"
Plastic loop concave up
72
72
FIG. 15
4 each Black Nylon
.60 x 1.5" x 8"
Folded/Sewn Handhold
8"
6"
1"
1"
76
FIG. 16
2 each Cross Ties
1 each 2"x 25" Stiff Nylon
2 each 2"x 22" Stiff Nylon
Sewn together
¾ inch holes
2 Cross Ties Per Assy.
1.5"
5"
A
B
74
FIG. 17
4 each 1.5"x 10.25" Stiff Nylon
¾ inch holes
4 Hand Supports Per Assy.
72
FIG. 18

BALLISTIC ARMOR

CROSS-REFERENCE TO RELATED APPLICATIONS

This application claims the benefit of priority under 35 USC 119(e) of U.S. provisional application No. 62/772,332, filed on Nov. 28, 2018, U.S. provisional application No. 62/680,289, filed on Jun. 4, 2018, and U.S. provisional application No. 62/638,714, filed on Mar. 5, 2018.

BACKGROUND OF THE INVENTION

Gun attacks in schools, churches, workplaces and other public gathering places have become all too commonplace. With effective methods of preventing attacks being virtually non-existent, the danger of a gun attack in nearly any public space is real and cannot be dismissed. Despite the increasing frequency of such attacks, there is currently a lack of an effective way to defend oneself against such an attack that is inconspicuous and non-threatening in the environment in which it is deployed.

The vast majority of our population and the areas we frequent are unprotected, leaving countless innocent children and adults vulnerable to unspeakable attacks. Victims often have no or very little warning of the danger. This compounds the problem, as any solution to protect against an attack must have immediate activation. There are only milliseconds available to present a defense. Once an attack starts, it then becomes a matter of protection until law enforcement and public safety personnel help to stop the aggression. The first victim currently has nothing for an immediate defense, the courageous are left exposed while seeking to help others, and taking cover is all too often ineffective.

With respect to schools, in the event of an active shooter, students, teachers and staff are generally trained to get out of the area of the shooter as quickly as possible. However, there may not always be a safe or readily apparent escape route, and the location of the shooter may not be known. Pursuing an escape route could inadvertently put you within sight of the shooter. On the other hand, staying in place or hiding may trap you within one area, and may render you defenseless if the shooter discovers you.

The root causes of attacks and the solutions proposed to prevent such attacks have recently been a subject of heated public debate. However, the effectiveness and the ability to implement any of the currently proposed social and legal changes are in question and will likely take an extended period of time.

SUMMARY OF THE INVENTION

The present invention provides an effective, easily accessible and inconspicuous means to defend oneself against a gunfire attack in a school or other public space, that requires little training or special knowledge and experience. Inconspicuous ballistic armor is provided that is incorporated into and disguised within common articles within a particular environment. One implementation of the invention, suitable for a school environment, is a ballistic armor or shield in the form of a desktop calendar. A relatively lightweight, ballistic shield having the approximate size dimensions of a desktop calendar is provided. The ballistic shield is formed with hand and arm straps on a rear surface, to allow a student or staff member to easily hoist the ballistic shield and use it as an effective and mobile shield or barrier against a gunfire, knife or other attack. An actual desktop calendar is attached to the front or upward-facing surface of the ballistic panel, such that in ordinary, everyday use, the ballistic shield inconspicuously rests on the desk surface and can be actually used as a desktop calendar, yet can be easily and immediately picked up and deployed in an active shooter situation.

A second embodiment of the invention includes a thin sheet of hardened steel that is affixed to a ballistic shield core. The thin sheet of hardened steel includes edge regions that wrap around and extend to the rear of the shield, such that hand holds and arm straps may be fastened to the edge regions of the hardened steel, with no requirement of any holes or fasteners extending through the ballistic material of the core itself.

Another embodiment of the invention includes an autonomous alert and protection system via connection of the shields on a particular campus or other location to the Internet of Things (IoT). When shield motion of a predefined acceleration and time is detected by the system, the system "awakens" and an alert is immediately and wirelessly sent by a processor on the shield to a central server, which in turn alerts first responders. On the shields themselves, audio and visual alert capabilities are provided that are activated in the event of detection of motion of at least one shield in the campus or other environment. Within the processing chip, edge processing is used to store data and perform computations that include maps and pre-recorded audio. Software on a user-connected computer or mobile device is connected to the central server, and generates an online map of the campus or other environment including locations and movement of the shields. Each shield is depicted as an icon on the online map, with its color or appearance indicating whether the shield is moving, its rate of motion and whether the user of the shield has pressed a button indicating that an attacker is in sight. The various types of data gathered by the shield and sent to the server can be used to generate a grid overlaid on the map showing the probable attacker location and predictive movement of the attacker (i.e., similar to a hurricane tracking grid). This data includes which shields are moving, at which locations, and at what rates, the order of movement of the shields, and which shields are signaling that an attacker has been seen and is in sight.

BRIEF DESCRIPTION OF THE DRAWINGS

FIG. 7 is a front view of a hand and arm strap according to the present invention.

FIG. 8 is a rear view of a hand and arm strap according to the present invention.

FIG. 9 is a front view of a hand strap according to the present invention.

FIG. 10 is a sectional view showing a cross-linked polyethylene closed cell foam cushioning pad and fasteners according to the present invention.

FIG. 15 includes front and rear views of an arm strap of the shield of FIG. 11.

FIG. 16 is a front view of a hand hold of the shield of FIG. 11.

FIG. 17 is a front view of a cross-tie of the shield of FIG. 11.

FIG. 18 is a front view of a nylon strap of the shield of FIG. 11.

DETAILED DESCRIPTION OF THE INVENTION

The present invention provides inconspicuous ballistic armor that can be easily incorporated into, assume the form of, or be disguised as common articles within a given environment. The environment may be any public gathering space, including, without limitation, elementary schools, middle schools, high schools, colleges and universities, churches, theaters, arenas and businesses. The ballistic armor should be of sufficient size and dimension to provide an effective barrier or shield against a gun, knife or other attack. In one embodiment of the invention, the inconspicuous ballistic armor takes the form of a desktop calendar that may be placed on top of a teacher's or student's desk and, in ordinary, everyday use, be used as a desktop calendar.

Figure 1:
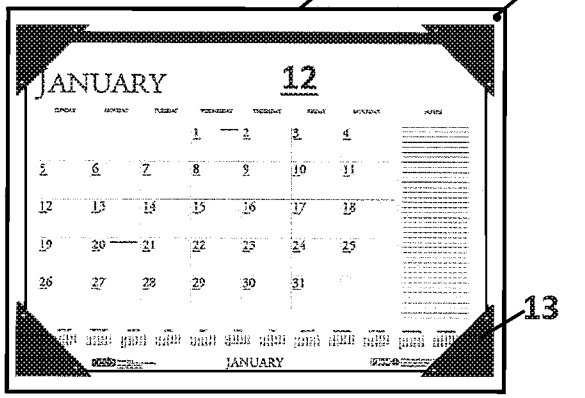
FIG. 1 is a top view of a small ballistic desktop calendar shield according to the present invention.
Figure 2:
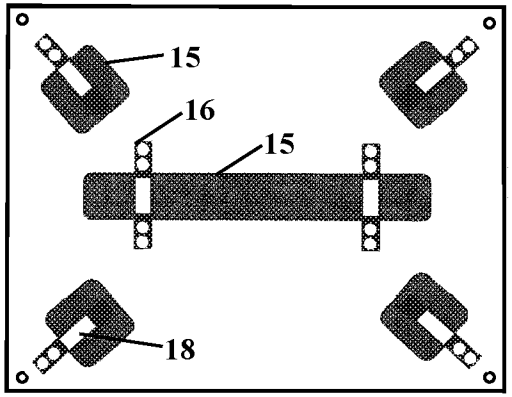
FIG. 2 is a bottom view of the small ballistic desktop calendar shield of FIG. 1.
Figure 3:
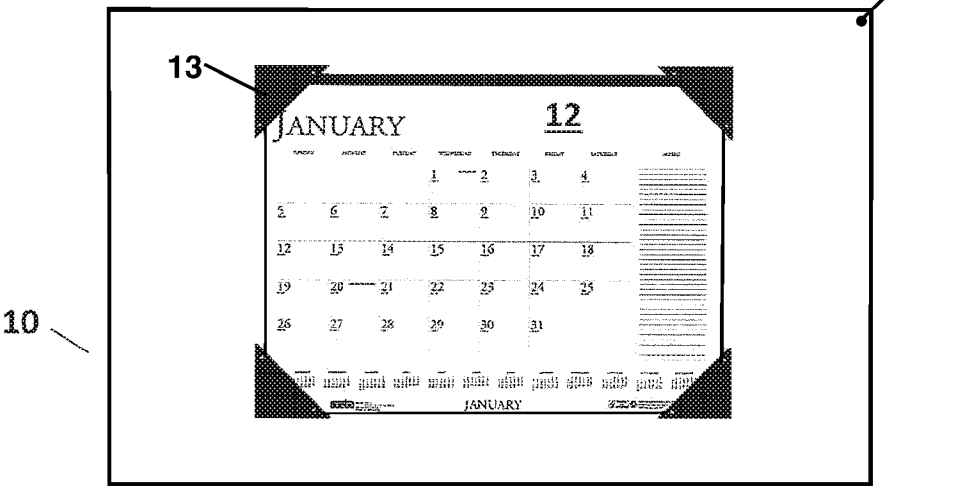
FIG. 3 is a top view of a large ballistic desktop calendar shield according to the present invention.
Figure 4:
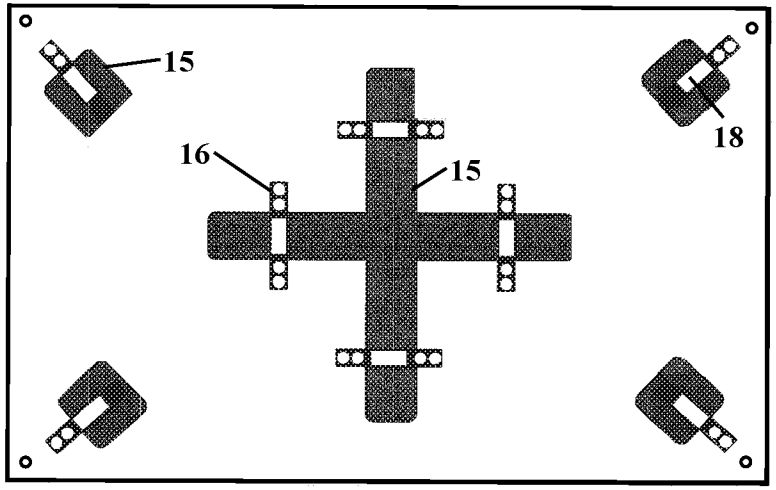
FIG. 4 is a bottom view of the large ballistic desktop calendar shield of FIG. 3.

FIGS. 1 and 2 show a smaller form ballistic shield that closely matches the size of an ordinary desktop calendar, typically more suitable for a child or younger student, whereas FIGS. 3 and 4 show a larger form ballistic shield that extends beyond the borders of a typical desktop calendar and provides a broader area of protection against attack, typically more suitable for a teacher or an older student. The armor or shield comprises a shield 10 formed of a ballistic material having a National Institute of Justice (NIJ) certified level of protection of at least type III (rifles) that provides an effective barrier against gunfire, and a weight that allows the panel to be lifted and held in a mobile fashion by a teacher or student without undue or extraordinary effort.

In one embodiment, ballistic shield 10 comprises a high strength and lightweight material such as Kevlar® brand para-aramid synthetic fiber formed into a ridged panel. Alternatively, or in combination, thin, flexible ballistic composites made from two or more layers of unidirectional fibers held in place by flexible resins, steel, aluminum or alumina ceramic may be used. For example, shield 10 may be formed from a strong, flexible ultra-high molecular weight polyethylene (UHMwPE) material such as Endumax® brand fiber and/or Dyneema® brand fiber, and/or from a lightweight, high strength fiber such as Spectra Shield® brand fiber. Any of these materials may be used alone or in any combination to provide the desired level of ballistic performance. In one implementation, the UHMwPE material from which shield 10 is formed is Endumax® from Teijin Aramid B.V.

As shown in FIGS. 1 and 3, a desktop calendar 12 is attached to the front or top surface of shield 10. Desktop calendar 12 may be any commercially available desktop calendar and can be glued, taped, attached with Velcro® or otherwise affixed to the front or top surface of shield 10. In one implementation, calendar corner pockets 13 are provided on the top surface of shield 10 to allow the calendar to be slipped into corner pockets 13. In alternative embodiments, rather than a desktop calendar, a whiteboard covering, a corkboard covering or any other desired covering may be affixed to the front or top surface of shield 10. In an implementation in which shield 10 is hung from a wall, a photo or artwork covering may be provided on the top surface of shield 10. Still alternatively, a snap over picture frame may be affixed to the front surface of shield 10. The snap over picture frame flips open, allowing posters or pictures to be inserted or replaced with ease.

In addition, shield 10 may be covered with vinyl wrap, thereby enabling virtually any surface appearance to be placed on the shield. Shield 10 may have the look and texture of carbon fiber, brush metal or wood grain, for example. The vinyl wrap may be a solid color, a poster print, or any desired map or design.

In one implementation of the smaller shield embodiment of FIGS. 1 and 2, the shield is formed from Kevlar® brand para-aramid synthetic fiber and has a thickness of 0.25 inches. The desktop calendar has a height of 17 inches and a width of 22 inches, and the shield on which it is affixed has a height of 20.5 inches and a width of 25 inches, such that a shield border having a height of 1.75 inches is provided at the top and bottom of the calendar, and a shield border having a width of 1.5 inches is provided on the sides of the calendar. In this implementation, the shield has an area of 512.5 square inches and a weight of 0.012 pounds per square inch, such that the shield has a total weight of 6.05 pounds. The shield of this implementation is designed to provide protection against 9 mm bullets, 0.357 Magnum bullets, 0.44 Magnum bullets and lesser threats.

In another implementation of the smaller shield embodiment of FIGS. 1 and 2, the shield is formed from a fiber composite (such as Endumax®, Dyneema® and/or Spectra Shield®), and has a thickness of 0.75 inches. The desktop calendar has a height of 17 inches and a width of 22 inches, and the shield on which it is affixed has a height of 21 inches and a width of 25 inches, such that a shield border having a height of 2 inches is provided at the top and bottom of the calendar, and a shield border having a width of 1.5 inches is provided on the sides of the calendar. In this implementation, the shield has an area of 525 square inches and a weight of 0.026 pounds per square inch, such that the shield has a total weight of 13.7 pounds. The shield of this implementation is designed to provide protection against 5.56 mm 55 grain ammunition, 30 caliber 180 grain bullets, 0.308 NATO 150 grain FMJ ammunition and lesser threats.

In a further implementation of the smaller shield embodiment of FIGS. 1 and 2, the shield is formed from a fiber composite (such as Endumax®, Dyneema® and/or Spectra Shield®), and has a thickness of 0.95 inches. The desktop calendar has a height of 17 inches and a width of 22 inches, and the shield on which it is affixed has a height of 21 inches and a width of 25 inches, such that a shield border having a height of 2 inches is provided at the top and bottom of the calendar, and a shield border having a width of 1.5 inches is provided on the sides of the calendar. In this implementation, the shield has an area of 525 square inches and a weight of 0.027 pounds per square inch, such that the shield has a total weight of 14.2 pounds. The shield of this implementation is designed to provide protection against AK-47 7.62×39 sc M1943 MSC ammunition and lesser threats.

In one implementation of the larger shield embodiment of FIGS. 3 and 4, the shield is formed from Kevlar® brand para-aramid synthetic fiber and has a thickness of 0.25 inches. The desktop calendar has a height of 17 inches and a width of 22 inches, and the shield on which it is affixed has a height of 25 inches and a width of 41 inches, such that a shield border having a height of 4 inches is provided at the top and bottom of the calendar, and a shield border having a width of 9.5 inches is provided on the sides of the calendar. In this implementation, the shield has an area of 1025 square inches and a weight of 0.012 pounds per square inch, such that the shield has a total weight of 12.3 pounds. The shield of this implementation is designed to provide protection against 9 mm bullets, 0.357 Magnum bullets, 0.44 Magnum bullets and lesser threats.

In another implementation of the larger shield embodiment of FIGS. 3 and 4, the shield is formed from a fiber composite (such as Endumax®, Dyneema® and/or Spectra Shield®), and has a thickness of 0.75 inches. The desktop calendar has a height of 17 inches and a width of 22 inches, and the shield on which it is affixed has a height of 25 inches and a width of 42 inches, such that a shield border having a height of 4 inches is provided at the top and bottom of the calendar, and a shield border having a width of 10 inches is provided on the sides of the calendar. In this implementation, the shield has an area of 1050 square inches and a weight of 0.026 pounds per square inch, such that the shield has a total weight of 27.3 pounds. The shield of this implementation is designed to provide protection against 5.56 mm 55 grain ammunition, 30 caliber 180 grain bullets, 0.308 NATO 150 grain FMJ ammunition and lesser threats.

In a further implementation of the larger shield embodiment of FIGS. 3 and 4, the shield is formed from a fiber composite (such as Endumax®, Dyneema® and/or Spectra Shield®), and has a thickness of 0.95 inches. The desktop calendar has a height of 17 inches and a width of 22 inches, and the shield on which it is affixed has a height of 25 inches and a width of 42 inches, such that a shield border having a height of 4 inches is provided at the top and bottom of the calendar, and a shield border having a width of 10 inches is provided on the sides of the calendar. In this implementation, the shield has an area of 1050 square inches and a weight of 0.027 pounds per square inch, such that the shield has a total weight of 28.4 pounds. The shield of this implementation is designed to provide protection against AK-47 7.62×39 sc M1943 MSC ammunition and lesser threats.

In another implementation of the larger shield embodiment of FIGS. 3 and 4, the shield is formed from a fiber composite (such as Endumax®, Dyneema® and/or Spectra Shield®), and has a thickness of 0.75 inches. The desktop calendar has a height of 17 inches and a width of 22 inches, and the shield on which it is affixed has a height of 31 inches and a width of 50 inches, such that a shield border having a height of 7 inches is provided at the top and bottom of the calendar, and a shield border having a width of 14 inches is provided on the sides of the calendar. In this implementation, the shield has an area of 1550 square inches and a weight of 0.026 pounds per square inch, such that the shield has a total weight of 40.4 pounds. The shield of this implementation is designed to provide protection against 5.56 mm 55 grain ammunition, 30 caliber 180 grain bullets, 0.308 NATO 150 grain FMJ ammunition and lesser threats.

In a further implementation of the larger shield embodiment of FIGS. 3 and 4, the shield is formed from a fiber composite (such as Endumax®, Dyneema® and/or Spectra Shield®), and has a thickness of 0.95 inches. The desktop calendar has a height of 17 inches and a width of 22 inches, and the shield on which it is affixed has a height of 31 inches and a width of 50 inches, such that a shield border having a height of 7 inches is provided at the top and bottom of the calendar, and a shield border having a width of 14 inches is provided on the sides of the calendar. In this implementation, the shield has an area of 1550 square inches and a weight of 0.027 pounds per square inch, such that the shield has a total weight of 42 pounds. The shield of this implementation is designed to provide protection against AK-47 7.62×39 sc M1943 MSC ammunition and lesser threats.

It should be noted that the weights discussed above are for the shield alone. Once the ballistic armor is fully assembled with hand and arm straps, hardware for attaching the straps, etc., as discussed below, the weight of the fully assembled armor will be increased by approximately one pound.

In order to make the ballistic armor easily recognizable as ballistic armor, despite its inconspicuous appearance as an ordinary article in its environment, an identification icon 14 or other indicator may also be provided on the front surface of shield 10. In the illustrated embodiment, which of course is merely one example and not limiting, identification icon 14 takes the form of a small red icon or logo in the upper right corner of shield 10. Identification icon 14 may be of a glow-in-the-dark material. Thus, a person finding themselves in an active shooting situation will easily be able to recognize the article as ballistic armor, and quickly obtain and deploy it.

As shown in FIGS. 2 and 4, hand and arm straps are attached to the rear surface of shield 10. In the illustrated embodiments, the smaller-size shield 10 (FIG. 2) is provided with two arm and hand straps 16 in a central portion of the rear of shield 10, to allow for one-handed use of the ballistic armor. That is, the user places his/her arm through both straps 16 to completely support and deploy the armor with one arm/hand, while the other arm/hand remains free. The full size shield 10 (FIG. 4) is provided with four arm and hand straps 16 to assist in vertical or horizontal positioning. In addition, each shield 10 is provided with a hand strap 18 at each corner of the rear of shield 10, to allow for many possible grasping points and two-handed use of the armor. Straps 16 and 18 are shown in greater detail in FIGS. 7-9.

Straps 16 and 18 may be formed from any suitable material including, without limitation, nylon, polypropylene, cotton, polyester, Nomex®, Kevlar®, polybenzimidazole (PBI) fiber, Vectran® and Dyneema®. In one implementation, straps 16 and 18 are formed from a combination of nylon and synthetic rubber that allows the straps to stretch by as much as 50%. In one implementation, VELCRO® brand VELSTRETCH® loop fasteners are used. Alternatively, straps 16 and 18 may be formed from a non-stretch loop, or a combination of stretch and non-stretch materials.

Figure 5:
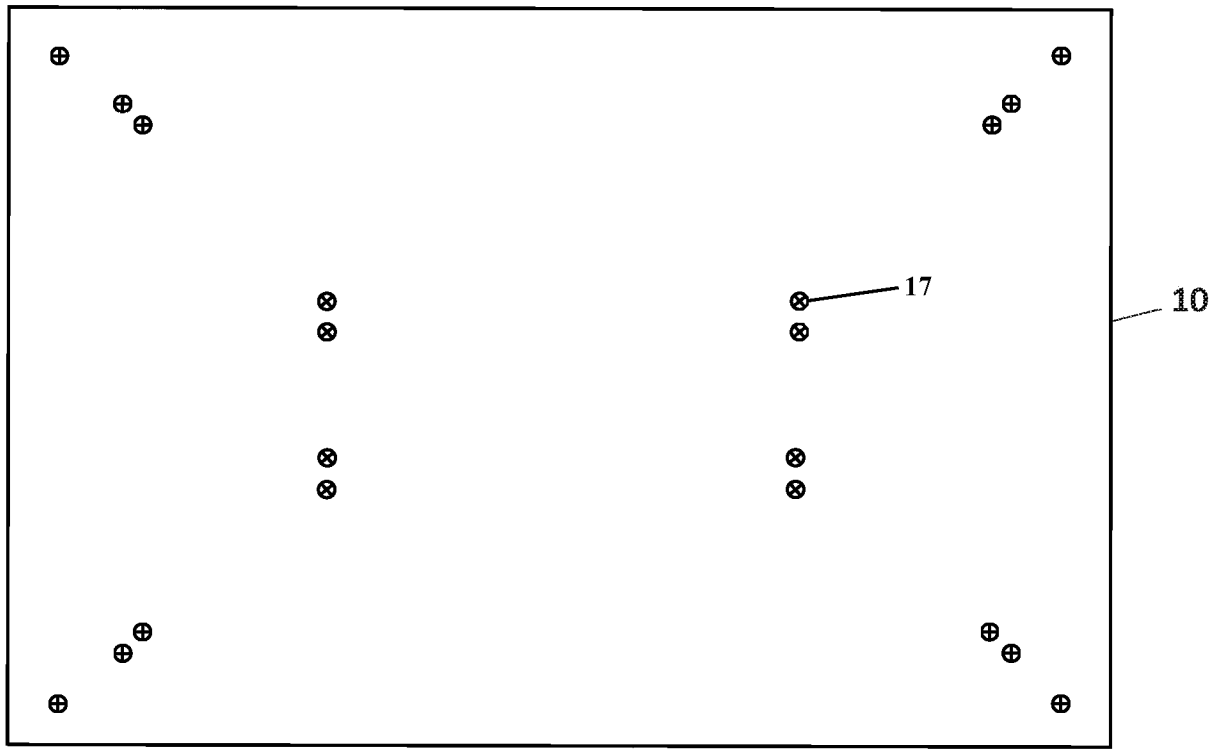
FIG. 5 is a top view of a small shield according to the present invention with holes formed for strap attachment.
Figure 6:
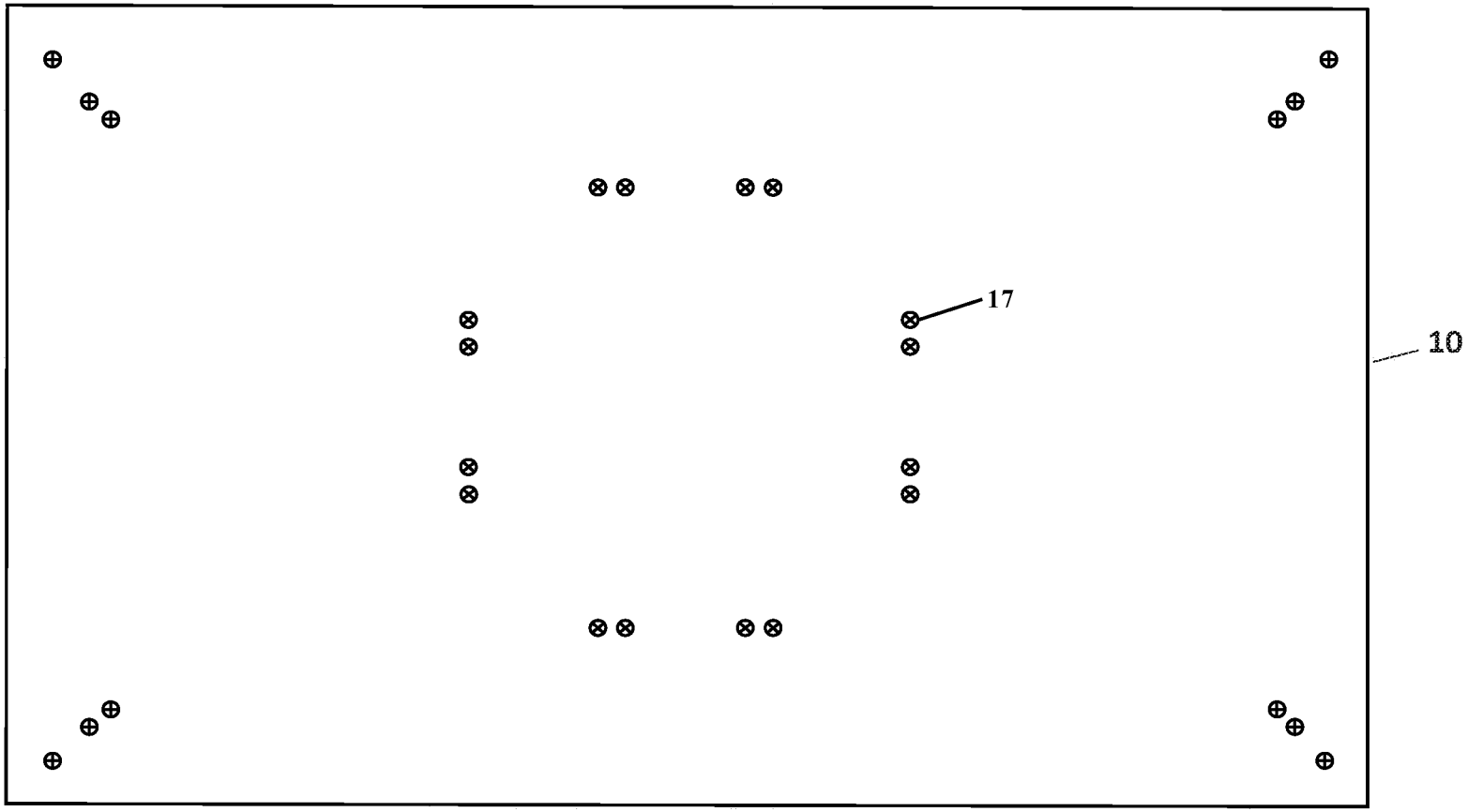
FIG. 6 is a top view of a large shield according to the present invention with holes formed for strap attachment.

Straps 16 and 18 are riveted, bolted or attached to the rear surface of shield 10. As shown in FIGS. 5 and 6, appropriately sized and spaced holes 17 are formed in shield 10 to facilitate attachment of straps 16 and 18 to shield 10. In one implementation, a specialty fastener known as a Huck-tainer® fastener system by Arconic is used. The Huck-tainer® fastener system is a cross between a bolt/nut and a rivet. It is very strong and allows for easy assembly. It has a wide surface area on both ends to better secure the straps. It is made specifically for fiber panes and limits torque at install to a specific amount. It comes with low profile PVC caps on the bolt head, resulting in a non-scratch pad for the desk or wall mounting. The PVC pads also position or raise the panel off the desk or wall, or other horizontal or vertical surface, enabling for easy handheld access and movement.

As shown in FIGS. 2 and 4, cushions or pads 15 may be provided that extend between and under straps 16 and 18 to facilitate arm and hand comfort when deploying the shield. In one implementation, cushion or pad 15 comprises a crosslink polyethylene close celled foam pad. Pad 15 is illustrated in more detail in FIG. 10.

In a second embodiment of the invention, in addition to a core formed from a ballistic material as described above, the shield also includes a sheet of hardened steel affixed to its front surface. A shield 50 according to the second embodiment of the invention is illustrated in FIGS. 11-21. As in the first embodiment, shield 50 has a National Institute of Justice (NIJ) certified level of protection of at least type III (rifles) that provides an effective barrier against gunfire, and a weight that allows the shield to be lifted and held in a mobile fashion by a teacher or student without undue or extraordinary effort. Shield 50 comprises a core 52 formed of a ballistic material such as, for example, a strong, flexible ultra-high molecular weight polyethylene (UHMwPE) material such as Endumax® brand fiber and/or Dyneema® brand fiber. In one implementation, the UHMwPE material from which shield 50 is formed is Endumax® from Teijin Aramid B.V. Core 52 preferably has a thickness in the range of 0.500-0.750 inches.

Figure 13:
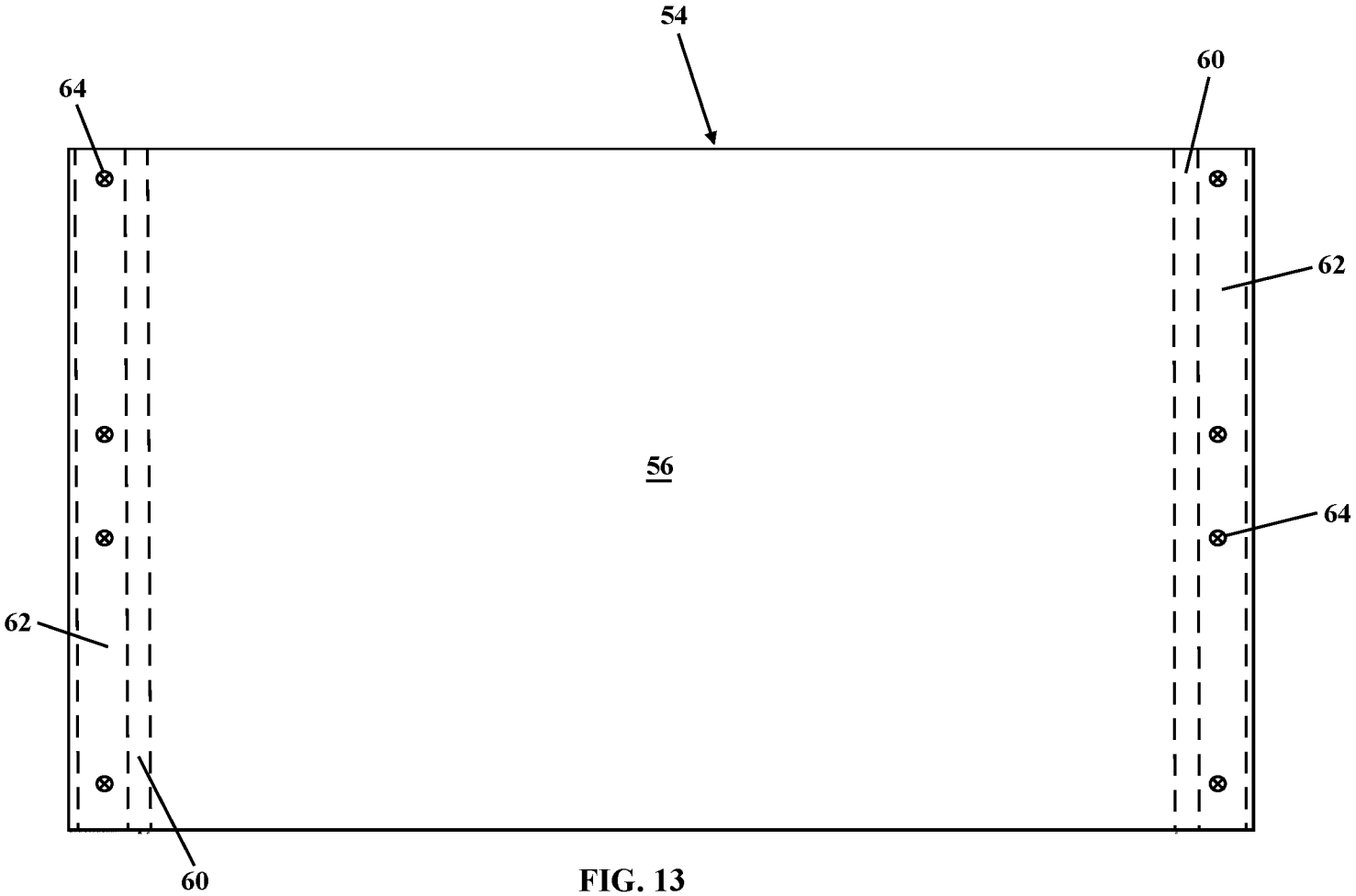
FIG. 13 is a plan view of the hardened steel sheet of the shield of FIG. 11.
Figure 14:
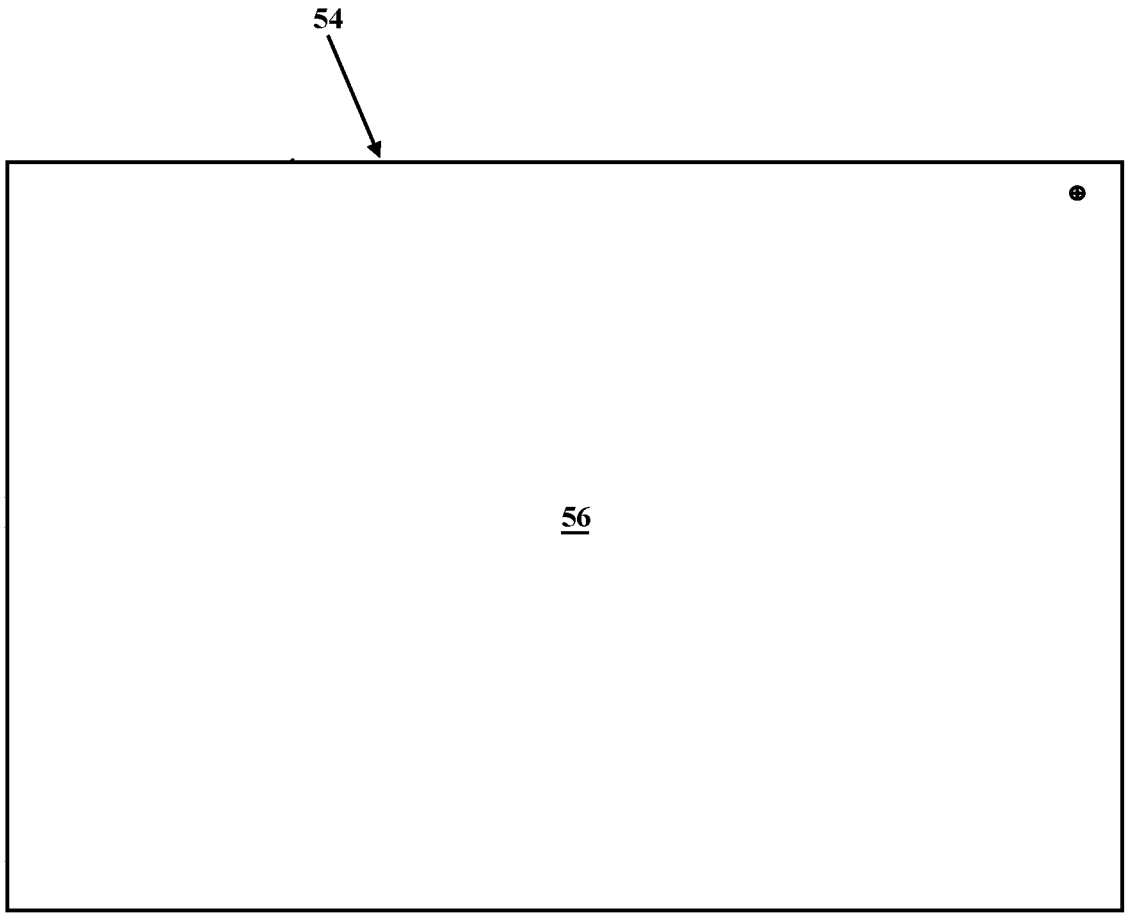
FIG. 14 is a plan view of the hardened steel sheet of FIG. 13, with edge regions bent.

Shield 50 is characterized by a sheet 54 of hardened steel that is installed over the front surface of core 52. In one implementation, hardened steel sheet 54 is an abrasion-resistant (AR) steel such as Hardox® 450 manufactured by SSAB and has a thickness of 0.028 inches. Hardened steel sheet 54 is illustrated in more detail in FIGS. 13-14. As shown in FIGS. 13-14, hardened steel sheet 54 includes a front surface 56 and edge regions 58. In one implementation, front surface 56 has a width of 25 inches and a height of 20.5 inches. Edge region 58 is bendable about the dashed lines shown in FIG. 13 to define a side edge 60 that extends from the front to the rear on the sides of core 52, and a rear edge 62 that extends partially behind core 52 (see FIGS. 11 and 12). In one implementation, side edge 60 has a width of 0.78125 inches, and rear edge 62 has a width of 1.125 inches.

To facilitate the attachment of arm straps and hand holds on the rear of shield 50, fastener pins 64 are installed through rear edge 62 of hardened steel sheet 54. In one implementation, as shown in FIG. 13, eight aluminum MGP30 fastener pins 64 are installed through rear edge 62. A shown in FIG. 13, fastener pins 64 may be installed 3.0 inches above and below the horizontal centerline of rear edge 62, and 9.375 inches above and below the horizontal centerline of rear edge 62.

Figures 11, 12:
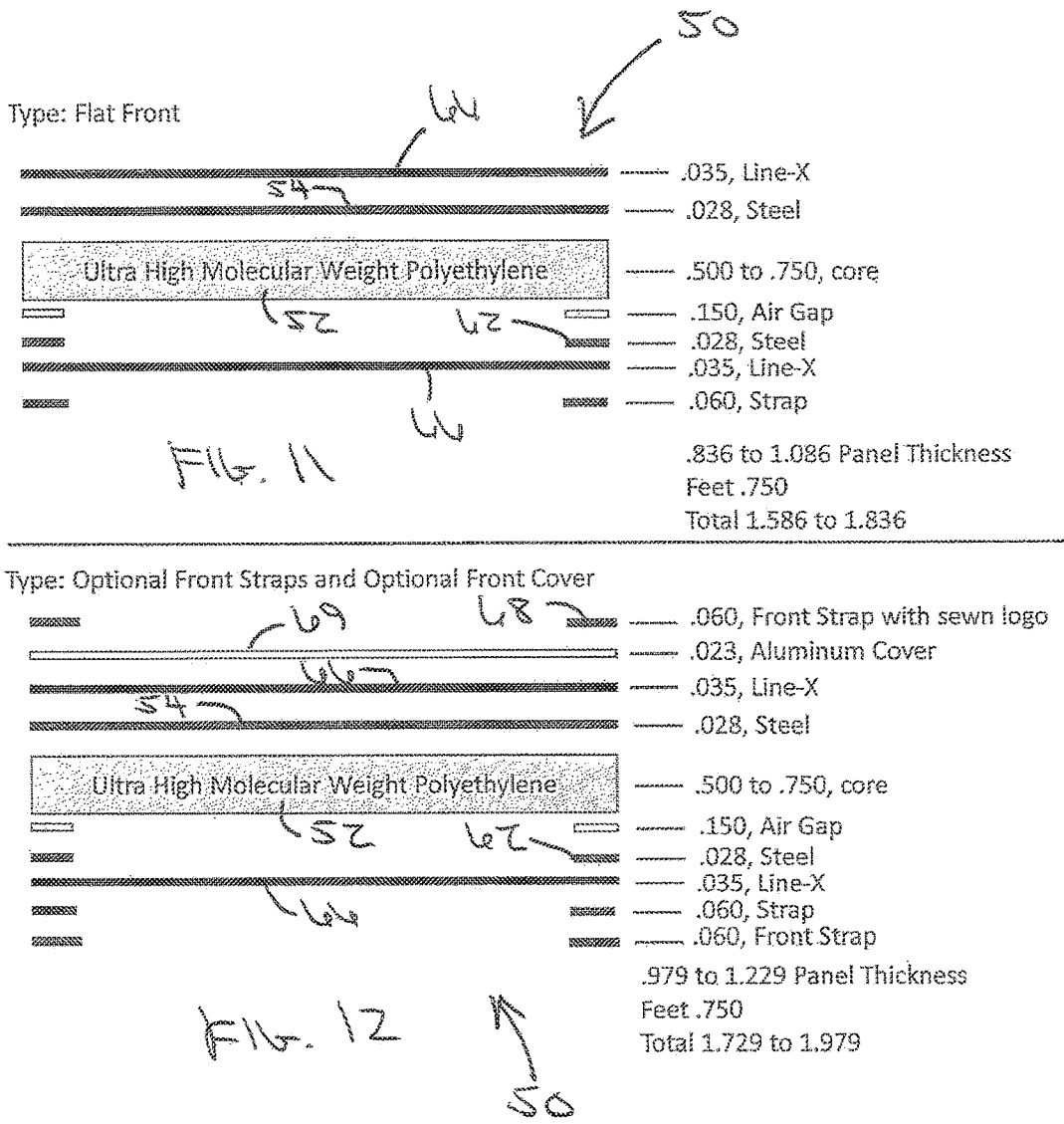
FIG. 11 is a sectional view of a shield including a hardened steel sheet according to a second embodiment of the invention.
FIG. 12 is a sectional view of the shield of FIG. 11 with the addition of optional front straps and a front cover.

Hardened steel sheet 54 is fixed to core 52 by applying an epoxy resin between core 52 and steel sheet 54, and then clamping sheet 54 to core 52 while the epoxy resin hardens. In addition, core 52 and steel sheet 54 are preferably encapsulated by a protective coating layer 66 (FIGS. 11-12). In one implementation, protective coating layer 66 has a thickness of 0.035 inches and is a spray-on coating such as Line-X® coating manufactured by Line-X LLC.

The combination of a core formed from an ultra-high molecular weight polyethylene and thin sheet of hardened steel over the front surface of the core provides a synergistic effect in dispersing the force of an impinging bullet. A bullet that strikes shield 50 first impacts hardened steel sheet 54. The bullet is slowed down by sheet 54 and forms a hole through sheet 54. As the bullet forms a hole and passes through sheet 54, edges of the steel sheet surrounding the hole in the sheet flair out and push into the material of the immediately adjacent core 52. This phenomenon is known as bullet "spalling". The steel fingers and fragments pushing into core 52 interact with the core material to create a synergistic effect, further slowing the bullet down and trapping it within core 52.

The use of a protective coating layer 66 such as Line-X® coating serves to further strengthen and protect shield 50. Protective coating layer 66 encapsulates shield 50, and protects steel sheet 54 from rusting. Importantly, the protective coating also captures bullet fragments created when the bullet hits the shield (bullet "splashing"), thereby protecting the user of the shield and other bystanders from bullet shrapnel and fragments.

In one optional implementation, shown in FIG. 12, shield 50 further comprises front straps 68 that extend around shield 50 at the left and right edges. Front straps 68 assist in installation of an optional front cover 69. Front cover 69 may be, for example, an aluminum cover or a plastic cover. In this regard, a front cover may be installed on the shield whether or not front straps 68 are present.

Figure 19:
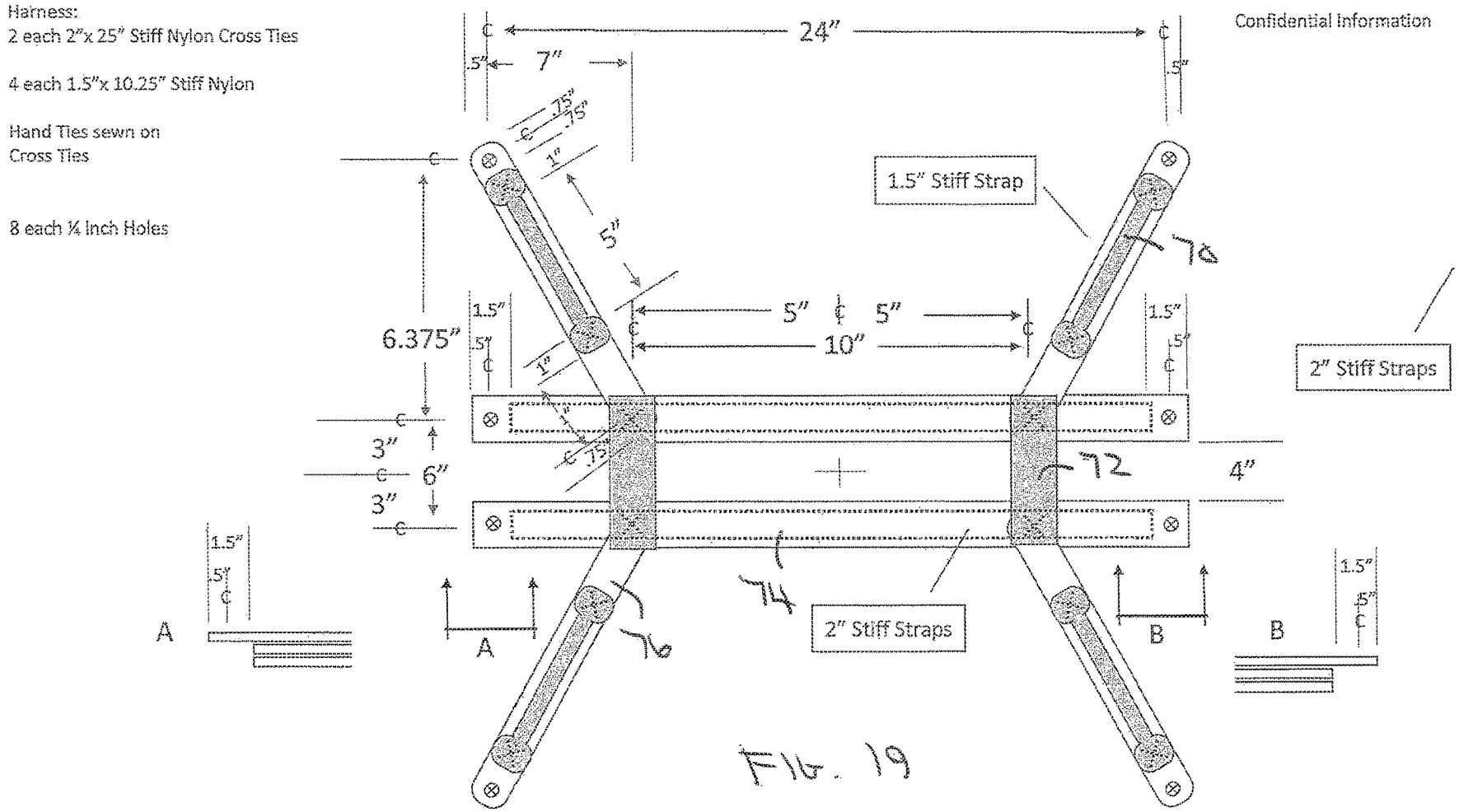
FIG. 19 is a plan view showing the hand holds and arm straps of FIGS. 15 and 16 attached to the cross-ties and nylon straps of FIGS. 17 and 18.
Figure 20:
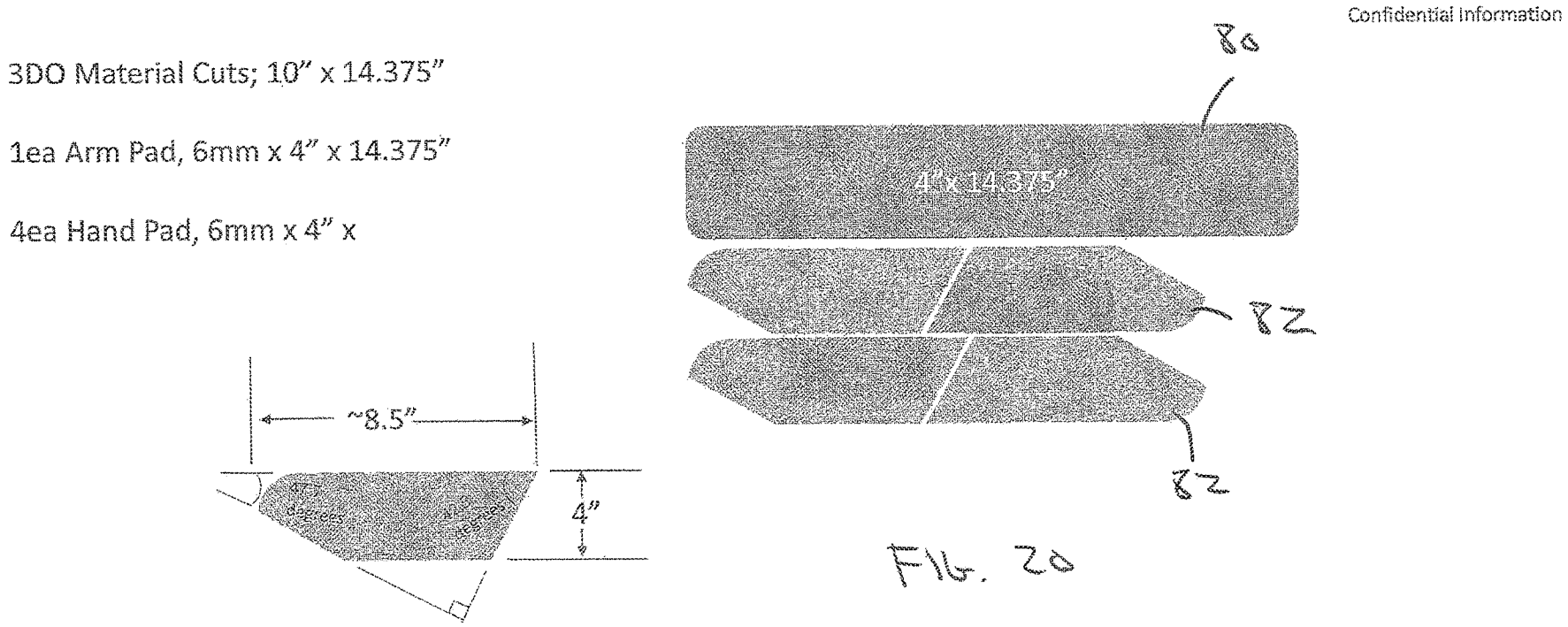
FIG. 20 is a plan view of arm and hand pads of the shield of FIG. 11.
Figure 21:
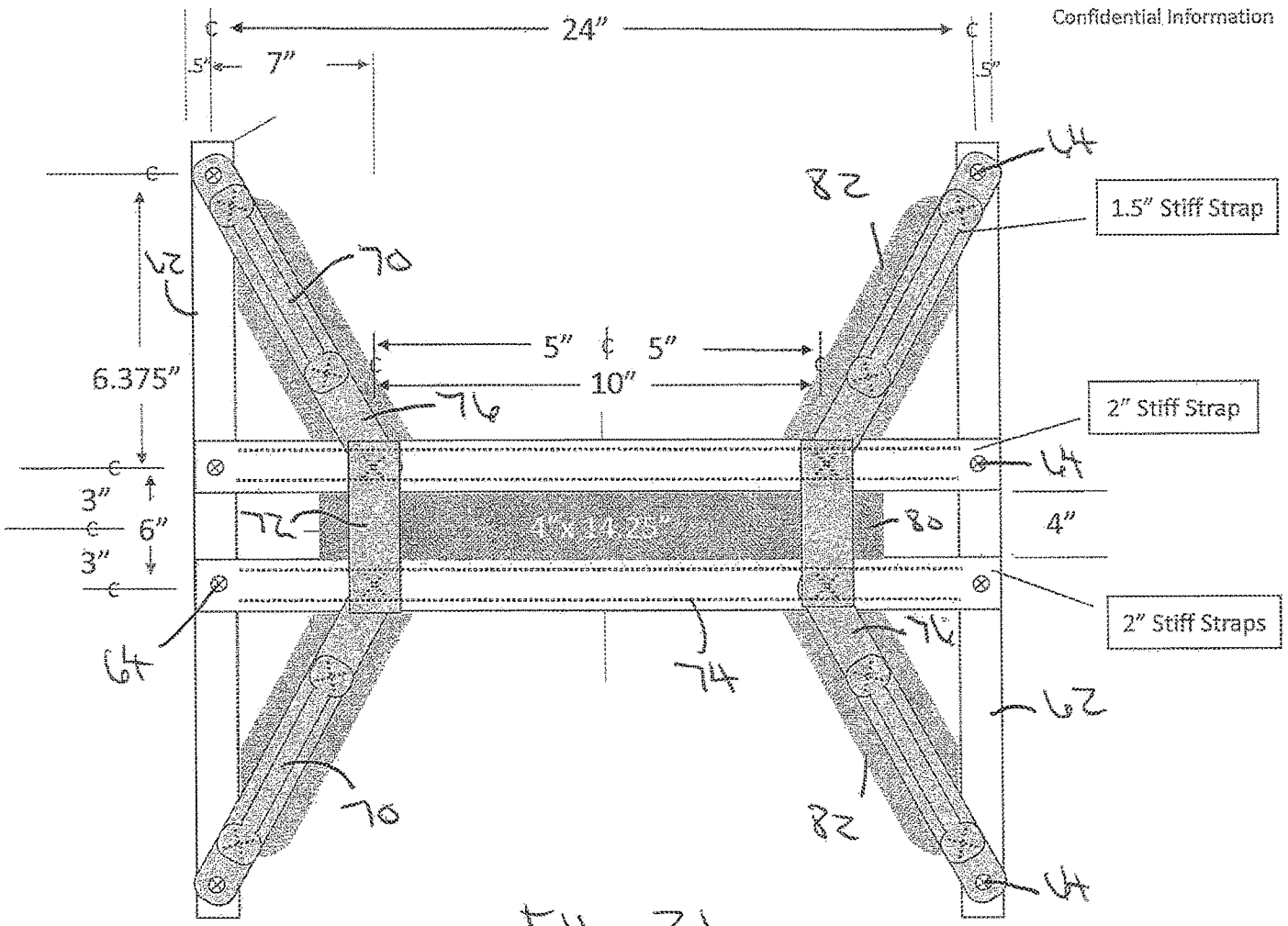
FIG. 21 is a plan view showing assembly of the arm straps, hand holds, cross-ties, nylon straps and arm and hand pads to the rear of the shield of FIG. 11.
Figure 22:
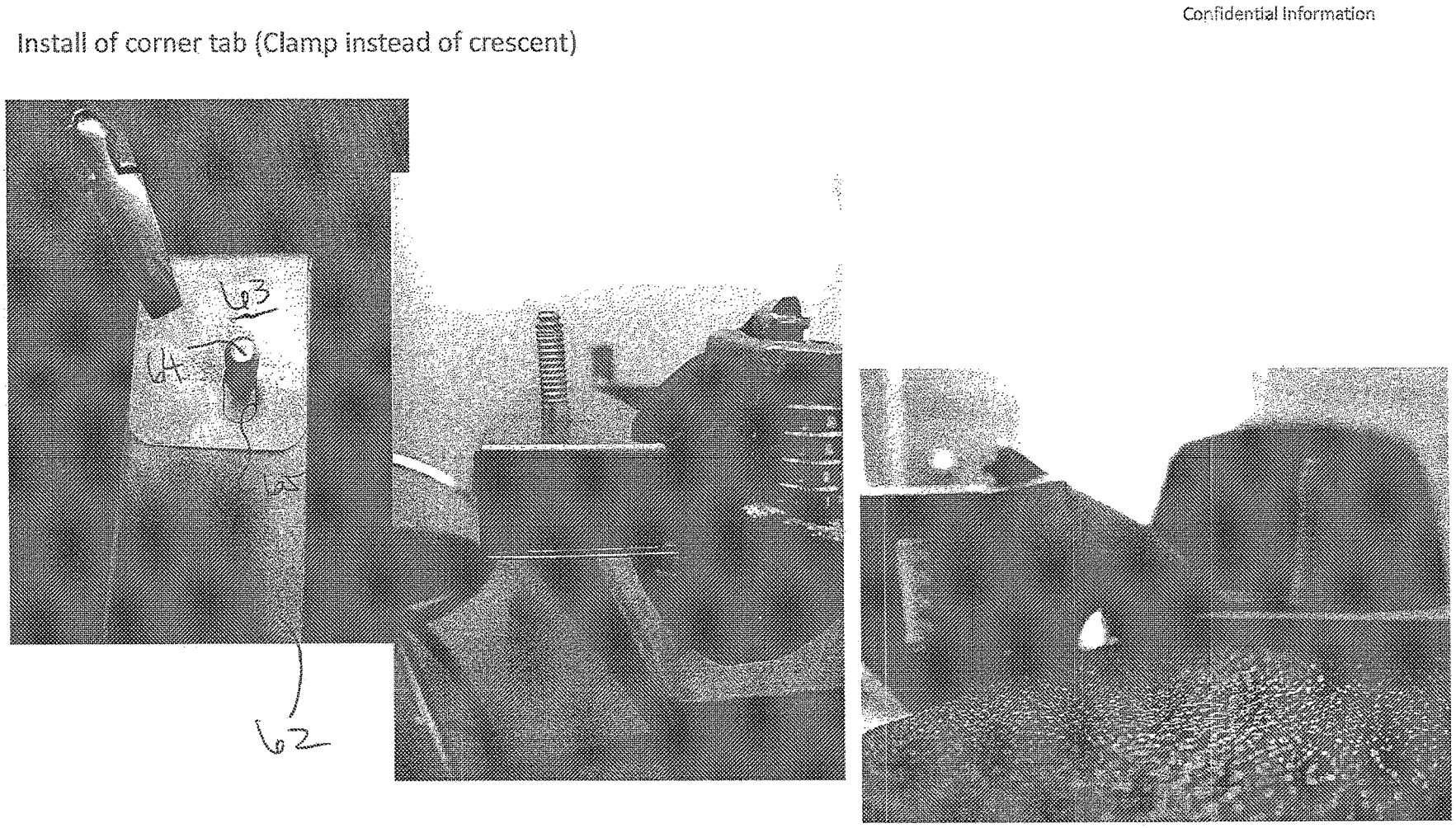

As shown in FIGS. 15-21, hand holds 70 and arm straps 72 are mounted on the rear of shield 50. As best seen in FIGS. 19 and 21, hand holds 70 and arm straps 72 are mounted to the rear of shield 50 via stiff nylon cross-ties 74 and straps 76 that are attached to fastening pins 64 extending through rear edge 62 of steel sheet 54. Cross-ties 74 extend between the two centermost fastening pins 64 of rear edges 62. Two arm straps 72 extend vertically between and are sewed to cross-ties 74. Four stiff nylon straps 76 are provided, with each strap being fastened at one end to a corner fastening pin 64 and sewed at the other end to cross-ties 74. Hand holds 70, in turn, are sewn to nylon straps 76.

As shown in FIGS. 20 and 21, arm pad 80 and hand pads 82 are affixed to core 52 underneath, respectively, arm straps 72 and hand holds 70 to facilitate arm and hand comfort when deploying the shield. Arm pad 80 is positioned is affixed to core 52 underneath cross-ties 74/arm straps 72, and hand pads 82 are affixed to core 52 underneath nylon straps 76/hand holds 70. Pads 80 and 82 are preferably formed from a closed cell polyurethane foam composite. In one implementation, pads 80 and 82 are formed from D3O, which is a polyurethane energy-absorbing material containing several additives and Polyborodimethylsiloxane, a dilatant non-Newtonian fluid. Polyborodimethylsiloxane is a substance that in its raw state flows freely but on shock locks together to absorb and disperse energy. Pads 80 and 82 are thereby able to assist in reducing the kinetic energy of a bullet or shrapnel on impact. The D3O pads 80 and 82 may optionally be covered with neoprene in order to provide further comfort.

The combination of an ultra-high molecular weight polyethylene (UHMwPE) core with a thin sheet of abrasion-resistant (AR) steel is advantageous and has applications beyond the shield described above. This combination may be used to provide ballistic protection in, for example, vehicles such as aircrafts and ships, body armor and helmets. In one implementation, the combination of an UHMwPE core and thin sheet of AR steel is implemented in an interior door panel or as a replacement for an interior door panel of a police car in order to provide ballistic protection. In one model, the panel is removable and has arm and handhold straps, so as to be usable for mobile ballistic protection. Additionally, the panel could have a dropdown panel extension to provide leg and feet ballistic protection when sheltering behind an open door.

The use of a thin sheet of abrasion-resistant steel allows reduction of the otherwise required thickness of the UHMwPE core. For example, if a UHMwPE core alone having a thickness of twelve inches is required to meet a certain threat level, the use of abrasion-resistant hardened steel with the UHMwPE core reduces the thickness of the core that is required to meet the threat level. For example, if used in combination with a sheet of AR steel having a thickness of ⅜ inches, the UHMwPE core may require a thickness of only nine inches (rather than twelve inches without the AR steel sheet). Thus, the use of a sheet of hardened AR steel in combination with a UHMwPE core advantageously addresses supply issues that may arise with respect to UHMwPE materials for the core, thereby providing supply and cost savings. In addition, the use of a steel sheet in combination with the UHMwPE core is advantageous in that attachment points can be provided through the steel virtually anywhere on the product without the necessity of putting fasteners through the core itself, or otherwise affecting the integrity of the core.

The use of a D3O interior (padding) in combination with the thin AR steel placed on a UHMwPE core provides yet further advantages, especially in personal armor applications (i.e. helmets, body armor, shields) where weight, bulk and level III protection is an even greater concern.

In an alternative implementation, the shield is made without steel on the front, except for a two inch board around the edges. This advantageously reduces the weight of the shield.

In one implementation, the ballistic armor incorporates digital chip technology that enables the armor to be an Internet of Things (IoT) connected device. Connecting the armor to the Internet enables movement of the armor to be autonomously tracked. This is of critical importance in an active attack situation for law enforcement or others to see mapped movements of the armor in real time. Thus, a tangible safety product (the shield) is provided and coupled with an IoT safety system that works without human intervention (autonomously). In a school or campus environment, situational awareness may be provided for 1-200+ shields per campus. Other applications could include fire extinguishers, defibrillators, etc.

In the event of an attack, the critical and best first move is immediate protective use of the shield to protect oneself and others from the attacker. Next, in order to provide immediate situational awareness to others on campus and first responders, an alert is sent out from the shield via the IoT connection. An accelerometer is built into the shield or processor in order to detect movement and rate of movement (acceleration) of the shield. The processor includes a GPS connection that determines and provides the location of the shield. When shield motion of a pre-defined acceleration and time is detected by the system, the system "awakens" and an alert is immediately sent by the processor on the shield to a central server which in turn alerts first responders.

Software on the shield processor stores data, performs computations and communicates with software on a user-connected computer or mobile device that is connected to the central server, and generates an online map of the campus or other environment including locations and movement of the shields. Within the processor, edge processing is used to store data and perform computations that includes maps and pre-recorded audio. The processor is highly capable and enables real time speeds. It has the ability of two way communications, including an accelerometer and blue tooth, wifi, cell and GSP connections. The processor also provides compass direction and gyroscopic direction.

In one implementation, a chip is utilized that includes four processors. One of the processors is an on-shield server. Another processor is used only for the asleep/awake process, thereby allowing for only micro amps of energy to be used while asleep, with the ability to wake up the processors on other shields in the event of an attack. In addition, each shield has its own battery. Since each shield has its own battery and processing capability, the shields can communicate with each other without the need of an outside power source.

Maps may be pre-loaded in order to assist response time and geo-fencing and may be integrated with mapping software or mobile applications already present on the device. Such software and mobile applications typically have great values of their own, and the addition of situational awareness information to the application during an attack or emergency situation combines to create an unmatched powerful solution. Integration with an existing mapping application is also advantageous in that, since the user likely already uses the application regularly, the user will likely already have proficiency and ease of use with the application.

The shields may be depicted on the map by icons such as rectangles or any other appropriate icon. The shield icon may change its color or otherwise have its appearance altered in the event of movement of the represented shield. For example, any shield in which movement has been detected may change from gray to green on the map. In addition, colors or words may be used to depict the rate of movement of the shield (ranging from low to rapid) detected by the accelerometer. For example, words ("stop", "walk", "run", "stairs", etc.) or icon colors/appearance may be used to depict the type of movement. Shield movement may be tracked room-by-room, and the timing order in which movement of various shields occurs may also be tracked. The percent of moving and non-moving shields may also be displayed based on accelerometer data.

On the shields themselves, audio and visual alert capabilities are provided that are activated in the event of detection of motion of at least one shield in the campus or other environment. For example, the shield may include visual alerts such as a light or other visual indicator, and audio alerts such as a buzz or vibration, and an alert status announcement. The shield may also include a display screen for displaying alert status messages.

The shields also include an "Attacker-In-Sight" button to be pressed by the user of the shield when the attacker is in sight. The pressing of this button causes a signal to be sent by the shield to the central server, which in turn changes the shield icon on the online map to indicate that an attacker is in sight of that particular shield. For example, a dot may be placed next to the shield icon to indicate attacker-in-sight. In one implementation, anytime the attacker-in-sight button is pressed, a blue dot tracks with the shield icon, and if the button is repeatedly and rapidly pressed, a red dot is placed next to the shield to indicate in real time that the attacker is within close proximity to that shield. The percentage of "red" shields and "blue" shields may also be displayed.

The various types of data gathered by the shield and sent to the server can be used to generate a grid overlaid on the map showing the probable attacker location and predictive movement of the attacker (i.e., similar to a hurricane tracking grid). This data includes which shields are moving, at which locations, and at what rates, the order of movement of the shields, and those shields signaling an attacker-in-sight.

At the first movement of any shield, all shields on the campus light and buzz alerting everyone of an attack and room-by-room tracking of each shield is initialized. The attacker-in-sight button can be used to send additional notifications. Audio/visual instructions to "stay-in-place" or real-time directional guidance through a safe escape path is provided to each affected individual. Mobile devices show arrowed paths to safety and audio directions guide each person away from the danger area. The mapped danger/safe area grids are also shared with first responders, enabling targeted response zones and shortening response times. Autonomous and manual inputs are configured based on campus needs, including the amount of movement required to alert, timeframes to alert, who is alerted, and what information is provided to each group.

Thus, the present invention provides autonomous alerts and campus wide "room-by-room" location tracking of each shield that is displayed and shared online. Two-way alert communications between the shield and online system are provided, facilitating real-time situational awareness for on-campus individuals and first responders. The instant physical protections of the shields and the improved response time through IoT technology is a powerful combination, since every fraction of a second of improved responsiveness can mean a life saved. In an attack, the quickest possible protection and response is critical. The short time available for mounting an effective response is coupled with a rapidly changing and complex environment, with the level of complexity directly tied to the number of people affected within confined areas. These difficult facts highlight the importance of not only instant and adaptable physical protections, but the value of real-time situational awareness for all effected people and responders.

The present invention provides inconspicuous ballistic armor disguised as an ordinary, everyday article in the environment in which it is deployed. Although the description has focused primarily on an implementation of a ballistic shield disguised as a desktop calendar, limitless other implementations are possible. To mention just a few alternative implementations, without limitation, the ballistic armor could be implemented as a hanging shield in which artwork is mounted on a front surface thereof, and hand/arm straps are affixed to a rear surface. The ballistic armor could be implemented as a cafeteria or restaurant tray with hand/arm straps on a rear surface thereof. In an environment including seating, the ballistic armor could be implemented as an easily detachable seat cushion, with the cushion attached to a front surface of the ballistic shield, and hand/arm straps attached to a rear surface of the ballistic shield. In sum, the crux of the present invention, which is a ballistic shield or barrier having an everyday article affixed to a front surface thereof, and hand/arm straps affixed to a rear surface thereof, may take on virtually limitless configurations.

In yet another alternative implementation, the ballistic armor is implemented as a white board, cork board, or standing display, and is mounted on wheels to be easily moved by rolling. The ballistic armor may be mounted, for example, on a stand such as a flat panel TV stand with wheels to permit rolling. An implementation in which a larger shield is mounted on a stand with wheels is advantageous in that the weight and larger size of the shield can be more easily handled; the use of wheels and possibly brakes makes the shield more mobile and easily movable; a larger area of protection is provided; and a height adjustable stand permits easy height adjustments of the shield.

The invention claimed is:

1. Ballistic armor comprising a ballistic shield; an article attached to a front surface of the ballistic shield; arm straps provided in a central portion of a rear surface of the ballistic shield; a hand strap provided at each corner of the rear surface of the ballistic shield; and caps on the rear surface of the shield that space the armor from a surface on which the armor rests to allow for easy handheld access and movement.

2. The ballistic armor of claim 1, wherein the article attached to the front surface of the ballistic shield is a calendar.

3. The ballistic armor of claim 1, wherein the ballistic shield is formed from any one or combination of a para-amid synthetic fiber, an ultra-high molecular weight polyethylene material, steel, aluminum and alumina ceramic.

4. The ballistic armor of claim 1, wherein two arm straps are provided.

5. The ballistic armor of claim 1, wherein four arm straps are provided.

6. The ballistic armor of claim 1, wherein digital chip technology is incorporated into the armor to connect the armor to the Internet and enable tracking of movement of the armor.

7. The ballistic armor of claim 1, wherein the arm and hand straps are bolted by bolts to the rear surface of the shield, and the caps cover heads of the bolts.

8. Ballistic armor comprising a ballistic shield; an article attached to a front surface of the ballistic shield; arm straps provided in a central portion of a rear surface of the ballistic shield; a hand strap provided at each corner of the rear surface of the ballistic shield; and pads affixed to the rear surface of the ballistic shield underneath the arm and hand straps.

9. The ballistic armor of claim 8, wherein the pads are formed from a closed cell polyurethane foam composite.

10. The ballistic armor of claim 8, wherein the pads are formed from a polyurethane energy-absorbing material containing a dilatant non-Newtonian fluid.

11. The ballistic armor of claim 10, wherein the dilatant non-Newtonian fluid is polyborodimethylsiloxane.

12. The ballistic armor of claim 6, further comprising an attacker-in-sight button to be pressed when an attacker is in sight, and which causes a signal indicating an attacker-in-sight to be generated and sent to a server via the Internet.

* * * * *